US005932508A

United States Patent [19]

Armstrong et al.

[11] Patent Number: 5,932,508

[45] Date of Patent: Aug. 3, 1999

[54] MANUFACTURE OF A METAL BONDED ABRASIVE PRODUCT

[76] Inventors: Caoimhin Padraig Armstrong, Ardreich, Athy, County Kildard; Patrick Gerard Ryan, 38 Granville Park, St Patricks Road, Limerick; Christopher Thomas Peters, Ballinacourty, Castleconnell, Limerick, all of Ireland; Christian Weiss, Mauernstrasse 38; Michael O'Sullivan, Alte Grenze 6, both of 29221 Celle, Germany; Johann Andries Bester, 63 Peterfield Street, Raceview, Alberton; Martin Walter Powell, 31 Silica Avenue, Dersley, Springs, both of South Africa

[21] Appl. No.: 08/922,475

[22] Filed: Sep. 3, 1997

[30] Foreign Application Priority Data

Sep. 4, 1996 [ZA] South Africa ..... 96/7468

[51] Int. Cl.[6] ..... B24D 3/02

[52] U.S. Cl. ..... 501/309; 264/65; 76/DIG. 12

[58] Field of Search ..... 51/309; 264/65; 76/DIG. 12

[56] References Cited

U.S. PATENT DOCUMENTS

| | | | |
|---|---|---|---|
| 4,142,872 | 3/1979 | Conradi | 51/307 |
| 4,378,975 | 4/1983 | Tomlinson et al. | 51/309 |
| 4,655,795 | 4/1987 | Bleecker et al. | 51/309 |
| 4,770,907 | 9/1988 | Kimura | 51/307 |
| 5,232,469 | 8/1993 | McEachron et al. | 51/309 |

*Primary Examiner*—Timothy M. Speer
*Attorney, Agent, or Firm*—McDermott, Will & Emery

[57] ABSTRACT

A method of manufacturing a metal bonded abrasive product such as a saw or drill segment or bead for a diamond wire is provided. The method includes the steps of providing a mixture of the metal, in particulate form, and the abrasive particles, cold pressing the mixture to the desired final shape at a pressure in the range 320 to 1500 MPa to produce a cold pressed product at a temperature in the range 900 to 1300° C. under conditions which inhibit degradation of the abrasive particles and the particulate metal. The product, after free sintering, will generally have a relatively high porosity, for example, a porosity of 10 to 25 percent by volume.

12 Claims, No Drawings

MANUFACTURE OF A METAL BONDED ABRASIVE PRODUCT

BACKGROUND OF THE INVENTION

This invention relates to a method of manufacturing a metal bonded abrasive product, particularly one wherein the abrasive is diamond.

Metal bonded diamond products are used extensively in cutting, milling and drilling. These products consist of a mass of discrete diamond particles dispersed in a metal bonding matrix. The metal bonding matrix will typically be cobalt, tungsten, nickel or iron, alone or containing a relatively low melting alloy such as bronze.

The most commonly used methods for producing such products are the hot press method, the free sinter densification method and the infiltration method.

The hot press method involves mixing the metal powder and diamond and then cold pressing the mixture to a desired shape. The pressures used in this step are typically between 50 and 300 MPa. The shaped product is then packed into a graphite mould pack. This mould pack is placed in a hot-press machine where it is subjected to elevated temperature and pressure. The elevated temperature is typically in the range of 800 to 1100° C. and the elevated pressure is typically in the range of 10 to 50 MPa. A volume change of up to 50% is not uncommon and the final density is usually 92 to 98,5% of theoretical density.

In the free sinter densification method, the manufacture of the cold pressed product is the same as in the hot press method. Thereafter, the shaped cold pressed product is placed on a support and sintered at a temperature of around 1000° C. No pressure is applied nor is a graphite mould pack used. There is thus nothing restraining the product during sintering. A volume change of up to 50% is not uncommon and the final density is usually 92 to 98,5% theoretical density.

The infiltration method involves cold pressing the mixture as for the hot press method. Thereafter, the shaped cold pressed product can be placed on a support with no graphite mould, or a graphite mould can be used. An infiltrant such as a copper based material in strip or granule form is placed on top of the product and this is all typically heated to a temperature of 950–1150° C. This causes the infiltrant to become liquid and to be drawn into the product thus filling the remaining spaces between the powder and diamond in the cold pressed product. There is generally no volume change and the final density is usually 100% of theoretical density.

In the methods described above the final density approaches 100% theoretical density with very little porosity in the final product.

Other methods of producing metal bonded abrasive products include the use of high pressure hot isostatic pressing. This method has the effect of removing porosity from the product, but is expensive. A hot isostatic pressing is often added as a final step to the other methods described above which has the effect of removing the porosity almost completely.

Another known method is to attach a single layer of diamond particles on to the surface of a substrate by means of electroplating.

SUMMARY OF THE INVENTION

According to the present invention, a method of manufacturing a metal bonded abrasive product includes the steps of providing a mixture of a metal, in particulate form, and abrasive particles, cold pressing the mixture to the desired final shape at a pressure in the range of 320 to 1500 MPa to produce a cold pressed product, and free sintering the cold pressed product at a temperature in the range of 900 to 1300° C. under conditions which inhibit degradation of the abrasive particles and the particulate metal.

The product, thus produced, will generally contain significant porosity and a porosity exceeding that of conventional metal bonded abrasive products. The porosity will typically be in the range 10 to 25 percent by volume, although porosities of up to 30 percent are possible. It has surprisingly been found that the porous products are as effective as the traditional non-porous products. Further, the method of the invention produces such porous products more economically than the traditional non-porous products.

The invention provides further an abrasive tool such as a saw, diamond wire, drill bit or coring bit containing a metal bonded abrasive product, manufactured as described above, as an abrasive insert.

DESCRIPTION OF EMBODIMENTS

The method of the invention has application in the manufacture of a wide range of metal bonded abrasive products including saw segments, drill bit segments, beads for diamond wire and mining products such as drill or coring bits.

The metal for the matrix may be iron or an iron-rich alloy, i.e. an alloy which is predominantly iron with minor amounts of metal additives characterised by having negligible dimensional volume change as a consequence of sintering.

The abrasive particles will typically be ultra-hard abrasive particles such as diamond or cubic boron nitride.

The abrasive particle content of the metal bonded abrasive product will vary according to the nature of the product. Generally, the abrasive particle content will not exceed 30% by volume of the product, but there are some cases where this is exceeded.

The cold pressing of the powdered mixture occurs at a high pressure in the range of 320 to 1500 MPa. The preferred pressure range is 400 to 850 MPa.

The cold pressed product is then free sintered, i.e. no pressure is applied and nothing restrains the product during sintering. The sintering takes place at a temperature in the range of 900 to 1300° C. with a preferred temperature being about 1050° C. to 1150° C. The free sintering must take place under conditions which inhibit degradation of the abrasive particle and also oxidation of the metal matrix. Any degradation of the abrasive particle or oxidation of the metal matrix will tend to weaken the ultimate product produced. The conditions for the free sintering step, particularly for diamond, will generally be an inert or reducing gas such as hydrogen or nitrogen or mixtures thereof, or a vacuum.

The free sintering step will not result in any significant volume change compared with that of the cold pressed product. The porosity existing in the cold pressed product will thus still be present in the final product. The final product produced by the method of the invention may have a porosity of up to 30% by volume and typically 10 to 25% by volume. This is a porosity which will also exist in the cold pressed product.

It is also possible to infiltrate the bonded product to tailor the properties of the product to a specific end use.

The method of the invention enables metal bonded abrasive products to be produced with high product consistency and close control of dimensional accuracy and tolerance. Further, it has been found that relatively inexpensive materials such as iron and iron alloys may be used and there is no need to use graphite pieces or moulds which reduces the costs of manufacture further.

The invention is illustrated by the following non-limiting examples.

EXAMPLE 1

A coring bit was produced utilising a plurality of metal-bonded segments containing synthetic diamond as the abrasive.

The segments were produced by mixing an iron-based powder with synthetic diamond and an oil/wax binder to hold the particles together. The iron-based powder consisted of 84,5 percent iron, 11 percent cobalt, 4 percent copper and 0,5 percent carbon, all percentages being by weight.

The mixture was cold pressed at a pressure of 450 MPa to produce segments which had the net shape and size of the final segments. The cold pressed segments were then placed in a furnace at a temperature of 1120° C. with a reducing atmosphere consisting of 20 percent hydrogen and 80 percent nitrogen, both percentages being by volume. The segments were held at this temperature for 30 minutes. The resulting sintered segments had a porosity of 15 percent.

The segments were then brazed on to a coring bit in the conventional manner. A similar coring bit was produced, except that the segments used were conventional cobalt-based segments, also containing synthetic diamond, and having substantially no porosity.

The two coring bits were subjected to a drilling test on a block of reinforced concrete. The drilling speed was 1200 rev/minute, and the time to drill a hole was measured in seconds:

| | |
|---|---|
| Conventional segments | 130.8 seconds |
| Porous segments of the invention | 154.2 seconds |

The porous segments of the invention were found to drill at a somewhat slower, but still acceptable rate. The projected life was calculated on the wear of the two segments and found to be:

| | |
|---|---|
| Conventional segments | 44.8 meters |
| Porous segments of the invention | 45.6 meters |

Thus, the porous segments of the invention offer a longer life than conventional segments and are less expensive to produce.

EXAMPLE 2

Diamond saw blade segments were produced using the method described in Example 1 with the following changes:

The iron-based powder consisted of 75,7 percent iron, 20 percent tungsten and tungsten carbide, 4 percent nickel, 0,3 percent carbon.

The segments were assembled on a steel circular blade using laser welding.

A circular blade containing cobalt-based saw segments with substantially no porosity was compared with a circular saw using porous segments produced as described above. The tests were conducted by cutting red brick for 17 hours and measuring the wear on the segments. This wear was found to be:

| | |
|---|---|
| Conventional segments | 0.4 mm wear |
| Porous segments of the invention | 0.3 mm wear |

Thus, the porous segments of the invention were found to wear at a slower rate when compared with conventional segments. The cutting rate through the bricks was similar in both cases.

EXAMPLE 3

Metal bonded diamond beads for use on a diamond wire were produced using an iron-based powder consisted entirely of iron. A mixture of the iron-based powder and diamond was loaded into an automatic cold pressing machine which pressed the mixture on to a solid steel ferrule at 800 MPa. This cold pressed product was placed in a furnace and exposed to a temperature of 1120° C. which was maintained for a period of 30 minutes. The reducing gas used in the furnace consisted of 10 percent hydrogen and 90 percent nitrogen, both percentages being by volume. The porosity of the sintered beads was found to be 15 percent.

The porous beads produced in this manner were threaded on to a steel wire rope and held in position on the rope by a vulcanised rubber layer. A similar diamond wire was produced using beads with substantially no porosity and produced by a method of the prior art.

A cutting test on cutting Belfast black granite was carried out using the two diamond wires. A 50 meter length of wire was used in each case. The cutting rate was measured and the number of square meters cut with each wire was measured:

| | |
|---|---|
| Conventional beads | 4 $m^2$/hour cutting rate; 475 $m^2$ cut |
| Porous beads of the invention | 3 $m^2$/hour cutting rate; 550 $m^2$ cut |

The porous beads of the invention were found to cut at a slightly slower rate, but found to have a longer life.

EXAMPLE 4

A mining bit of the type used to drill holes in rock to produce a core sample for geological examination was produced. An iron-based powder consisting of 84 percent iron, 11 percent cobalt, 4 percent copper and 1 percent carbon, all percentages being by weight, was used.

A mixture of the iron-based powder and diamond was loaded into a steel die, followed by a layer of the iron-based powder without diamond, for producing a layer to bond to a steel adaptor. The steel adaptor was placed on top of the diamond-free layer and an unbonded assembly was cold pressed at a pressure of 400 MPa. This produced a cold pressed product which was placed in a furnace and exposed to a temperature of 1120° C. in an atmosphere of 10% hydrogen and 90% nitrogen for a period of 30 minutes. The diamond-bearing layer of the product had a porosity of 15 percent.

The steel adaptor was machined and threaded to enable it to be inserted into a drill string. The bit was used to drill Norite at 1500 revolutions per minute with a thrust of 1500 kg. The penetration rate achieved was 150 to 200 mm/minute and the projected life of the bit was 40 to 50 m. This compares favourably with a bit made by prior art methods and containing about 5 percent porosity.

We claim:

1. A method of manufacturing a metal bonded abrasive product including the steps of:

providing a mixture of metal, in particulate form and selected from the group consisting of iron and an iron-rich alloy, and abrasive particles;

cold pressing the mixture to the desired final shape at a pressure in the range of 320 to 1500 Mpa to produce a cold pressed product having a porosity of 10 to 25% by volume; and free sintering the cold pressed product at a temperature in the range of 900 to 1300° C. under conditions which inhibit degradation of the abrasive particles and the particulate metal to produce a sintered product having a porosity of 10 to 25 percent by volume.

2. A method according to claim 1 wherein the pressure applied in the cold pressing step is 400 to 850 MPa.

3. A method according to claim 1 wherein the free sintering takes place at a temperature in the range 1050° C. to 1150° C.

4. A method according to claim 1 wherein porosity existing in the cold pressed product, is present in the product after free sintering.

5. A method according to claim 1 wherein the abrasive particles are ultra-hard abrasive particles.

6. A method according to claim 5 wherein the ultra-hard abrasive particles are diamond or cubic boron nitride.

7. A method according to claim 1 wherein the metal bonded abrasive product is selected from the group consisting of saw segments, drill bit segments, beads for diamond wire and mining products.

8. A method according to claim 7 wherein the mining products are selected from the group consisting of drill bits and coring bits.

9. A method according to claim 1 wherein the conditions of free sintering are an inert atmosphere, a reducing atmosphere or a vacuum.

10. A metal bonded abrasive product manufactured by a method according to claim 1.

11. An abrasive tool containing a metal bonded abrasive product according to claim 10 as an abrasive insert.

12. An abrasive tool according to claim 11 which is selected from the group consisting of a saw, diamond wire, drill bit and coring bit.

* * * * *